US006805220B2

(12) United States Patent
Fulton et al.

(10) Patent No.: US 6,805,220 B2
(45) Date of Patent: Oct. 19, 2004

(54) SAFETY SYSTEM TO PREVENT FALLS

(75) Inventors: Robert H. Fulton, North Delta (CA); Mauro Celenza, Coquitlam (CA)

(73) Assignee: Skyhook Fall Protection Design Ltd., Pitt Meadows (CA)

( * ) Notice: Subject to any disclaimer, the term of this patent is extended or adjusted under 35 U.S.C. 154(b) by 0 days.

(21) Appl. No.: 10/253,050

(22) Filed: Sep. 23, 2002

(65) Prior Publication Data

US 2004/0055818 A1 Mar. 25, 2004

(51) Int. Cl.[7] ..... A47L 3/04
(52) U.S. Cl. ..... 182/3; 182/5; 182/45
(58) Field of Search ..... 182/3, 5, 9, 45, 182/232–238, 7; 248/231.4, 237, 231.7

(56) References Cited

U.S. PATENT DOCUMENTS 4,560,131 A * 12/1985 Eck ..... 248/352
4,928,790 A 5/1990 Franks
5,004,071 A 4/1991 Mallard et al.
5,036,949 A 8/1991 Crocker et al.
5,092,426 A 3/1992 Rhodes
5,113,981 A * 5/1992 Lantz ..... 188/371
5,282,435 A * 2/1994 Chapman ..... 114/263
5,307,897 A * 5/1994 Turner et al. ..... 182/3
5,316,102 A * 5/1994 Bell ..... 182/3
5,320,193 A * 6/1994 Bongiovanni et al. ..... 182/3
5,346,036 A * 9/1994 Arisman et al. ..... 182/3
5,598,900 A * 2/1997 O'Rourke ..... 182/3
5,660,013 A * 8/1997 Saldarelli et al. ..... 52/296
5,694,720 A * 12/1997 Walcher et al. ..... 52/111
5,711,397 A 1/1998 Flora et al.
5,833,414 A * 11/1998 Feldman et al. ..... 410/151
6,053,457 A * 4/2000 Ozga et al. ..... 248/58
6,227,329 B1 * 5/2001 Ador ..... 182/3
6,474,441 B1 * 11/2002 Bertolino ..... 182/3
6,591,940 B2 * 7/2003 Desjardins ..... 182/36

FOREIGN PATENT DOCUMENTS

GB 2269623 * 2/1994 ..... 182/3 X

* cited by examiner

*Primary Examiner*—Bruce A. Lev
(74) *Attorney, Agent, or Firm*—Kolisch Hartwell, P.C.

(57) ABSTRACT

A system for securing a worker to an elevated structure includes a flexible anchor line extendable across the structure, hooks at opposite ends of the flexible anchor line for engaging the structure, and a line storage device for releasably storing a portion of the flexible anchor line to adjust the length of line and tension the line to bring the hooks into anchoring engagement with the structure and secure the anchor line to the structure. One end of a restraining line is releasably connectable to the flexible anchor line. The opposite end of the restraining line is connected to a harness wearable by the worker. The system is a lightweight and reliable apparatus that is easily transported and operated by a worker to secure the worker to an elevated structure such as a cargo container in order to conduct work in safety. The system acts either to restrain a worker from moving too close to the edge of the structure or, if the restraining line is sufficiently long, the system acts to arrest a fall if a worker should slip over the edge.

18 Claims, 6 Drawing Sheets

SAFETY SYSTEM TO PREVENT FALLS

FIELD OF THE INVENTION

This invention relates to a safety system for preventing a user from falling from an elevated structure, and, more particularly, to a safety harness system for use with intermodal cargo containers.

BACKGROUND OF THE INVENTION

Stackable cargo shipping containers are now one of the most common ways to transport goods around the world via ship, semi-trailer truck or train. These large containers are of standard construction and dimensions for carrying all manner of goods. During use of these containers, it is sometimes necessary for a worker to climb onto the top of a container or a column of stacked containers to perform repair, maintenance or cleaning tasks. For example, when stacked, containers are subject to tearing, denting or puncture damage of the roof of the lower containers which requires prompt repair. Before containers can be moved by trucks on roadways in winter, the roof of each containers must be cleared of any accumulated packed snow to prevent the snow from breaking off during travel and posing a threat to other traffic.

There is always the risk of a fall from the top of the container due to slipping, carelessness or pre-occupation while working at the edges or corners of the containers. Existing containers do not incorporate any tie off or mounting system for worker safety. To address the problem of worker safety on the containers, prior art systems have been developed. At some sites, repair work on containers is conducted in a special shop which includes a raised independent framework below which containers are positioned. The framework provides attachment points for a safety harness to be worn by a worker. The expense and work of transporting containers to the shop makes this approach practical only for damaged containers. Most repair work is performed in the field in remote areas with no overhead structure or crane to lift tools or safety devices into position. Any fall restraint system is therefore, preferably light, portable, easily deployed and flexible so that the worker can carry the system in a tool box or backpack or drape the system over the shoulder allowing hands-free climbing into position on top of the container. In this regard, many prior art devices are cumbersome, heavy and impractical.

U.S. Pat. No. 5,092,426 to Rhodes and U.S. Pat. No. 4,928,790 to Franks disclose safety devices mountable directly to the roof of a container. The systems are bulky and heavy, and require considerable manpower and time to install in place which makes them inefficient and expensive to use.

U.S. Pat. No. 5,036,949 to Crocker et al. discloses an apparatus that requires the worker to go to the edge of the elevated work surface and clamp down the edge hooks with thumb screws. This not only exposes the worker to falling over the edge while deploying the safety apparatus, but is slow and inefficient to deploy. The edge hook is not easily adaptable for attachment to the different edge configurations of containers used in the industry.

Mallard in U.S. Pat. No. 5,004,071 discloses a adapter bracket that is mountable to the corner of a cargo container with a retractable line attachable to a worker. This system also exposes the worker to the possibility of falling over the edge while deploying the system. Locating the bracket in a corner does not offer significant fall restraint protection in the mounting corner.

Flora et al. in U.S. Pat. No. 5,711,397 discloses a safety device that employs a rigid framework extending across the elevated surface. Like Rhodes and Franks, Flora et al. relies on the rigidity of the framework to absorb loads exerted by the restraining line.

SUMMARY OF THE INVENTION

In the interests of worker safety and efficiency, and to address the concerns of occupational safety experts, applicant has developed a novel safety system that addresses the drawbacks of the prior art. The system of the present invention provides a lightweight, readily mountable safety system that prevents a worker from approaching too close to the edge of a container or arrests a fall in the event that a worker does slip over the edge. The system of the present invention is designed to be installed by the worker without assistance from others to provide an efficient and reliable safety system.

Accordingly, the present invention provides a system for securing a worker to an elevated structure comprising:

a flexible anchor line extendable across the structure;

hooks at opposite ends of the flexible anchor line for engaging the structure;

a line storage device for releasably storing a portion of the flexible anchor line to adjust the length of line and tension the line to bring the hooks into anchoring engagement with the structure and secure the anchor line to the structure;

a restraining line releasably connectable to the flexible anchor line; and a harness wearable by the worker connected to the restraining line.

In a preferred arrangement, the hooks of the present invention are adapted to incorporate multiple hook arms to engage and secure the system to various cargo containers designs which incorporate different edge constructions. The hook arms preferably include lips that engage under the container edge to prevent the hook from dislodging in a vertical direction.

The system of the present invention acts to restrain a worker from moving too close to the edge surface of an elevated structure, or, if the restraining line is positioned inadvertently close to the end of the elevated structure, the system acts to arrest a fall when a worker topples over the edge. In addition, once a worker has deployed the system of the present invention from the top of a ladder centred at the ends of a container or from a service platform, the device will arrest a fall by a worker making the final move to the top of the container.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1A:
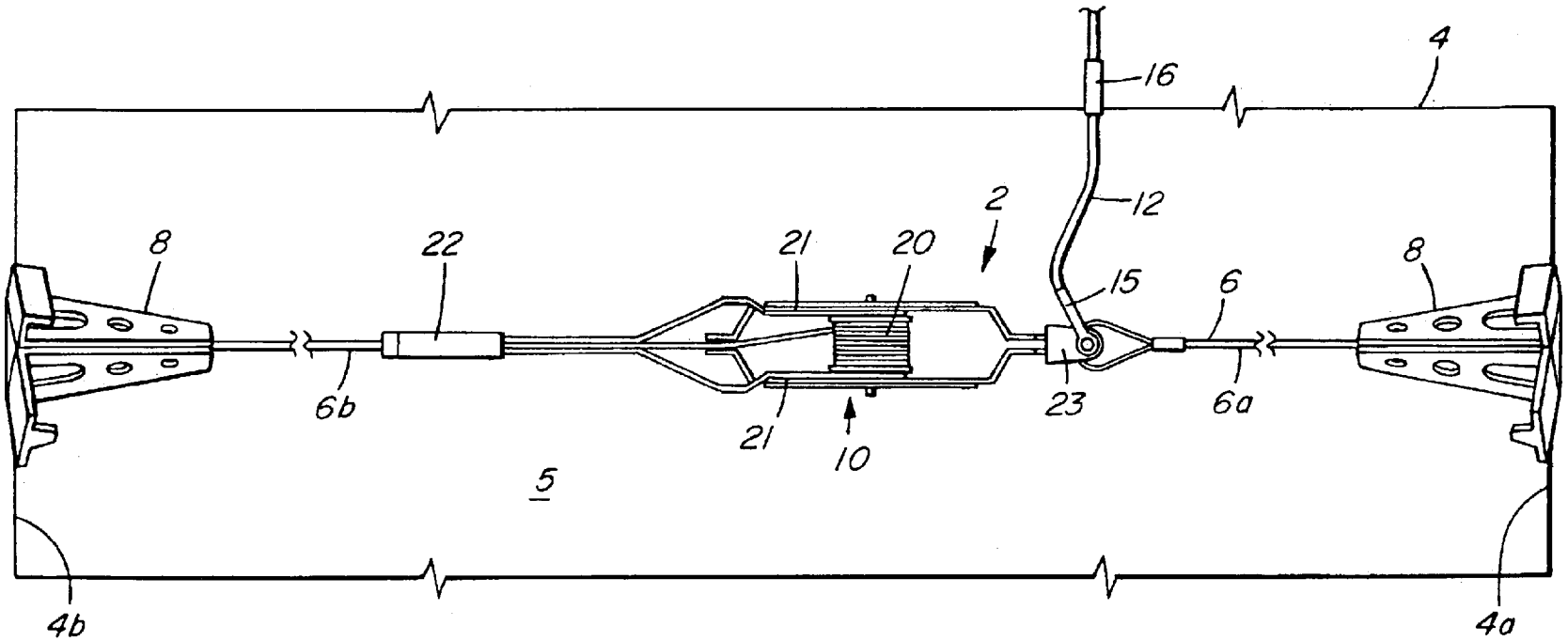
FIGS. 1*a* and 1*b* are plan and elevation views with broken away sections of a preferred embodiment of the safety system of the present invention.
Figure 1B:
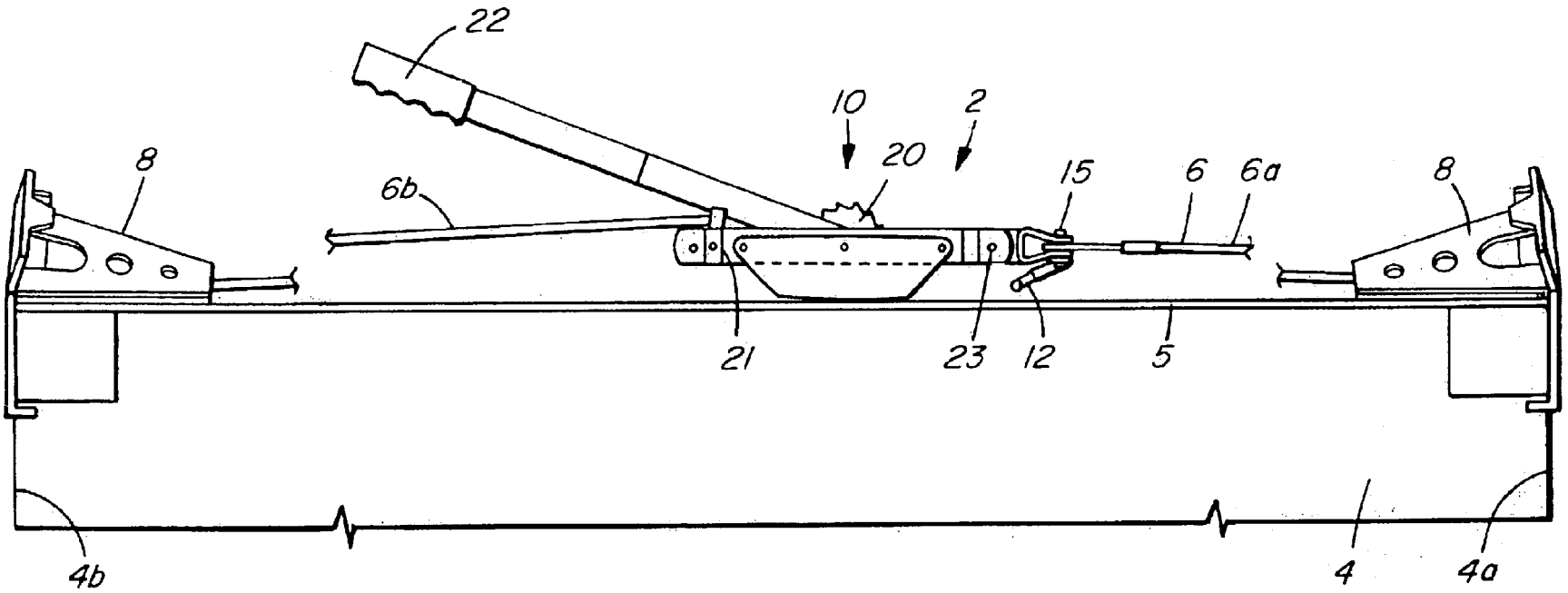

Referring to FIGS. 1*a* and 1*b*, there is shown a preferred embodiment of the invention comprising a system 2 for securing a worker to an elevated structure. The system is shown installed extending across the top surface 5 of a cargo container 4.

System 2 comprises a flexible anchor line 6 extendable between two edge surfaces 4*a*,4*b* of cargo container 4. Hooks 8 at opposite ends of the flexible anchor line 6 are used to mount the anchor line to container 4. Anchor line 6 is preferably galvanized aircraft cable for strength and lightness, however, other flexible line material of appropriate tensile strength can also be used, such as belts, straps or chains.

Intermediate the ends of anchor line 6, there is a line storage device 10 for releasably storing a portion of the flexible anchor line to permit adjustment in the length of line. Line storage device 10 thereby acts to tension the line to bring hooks 8 into anchoring engagement with edge surfaces 4*a*,4*b* to secure anchor line 6 across the top surface 5 of cargo container 4.

Figure 5:
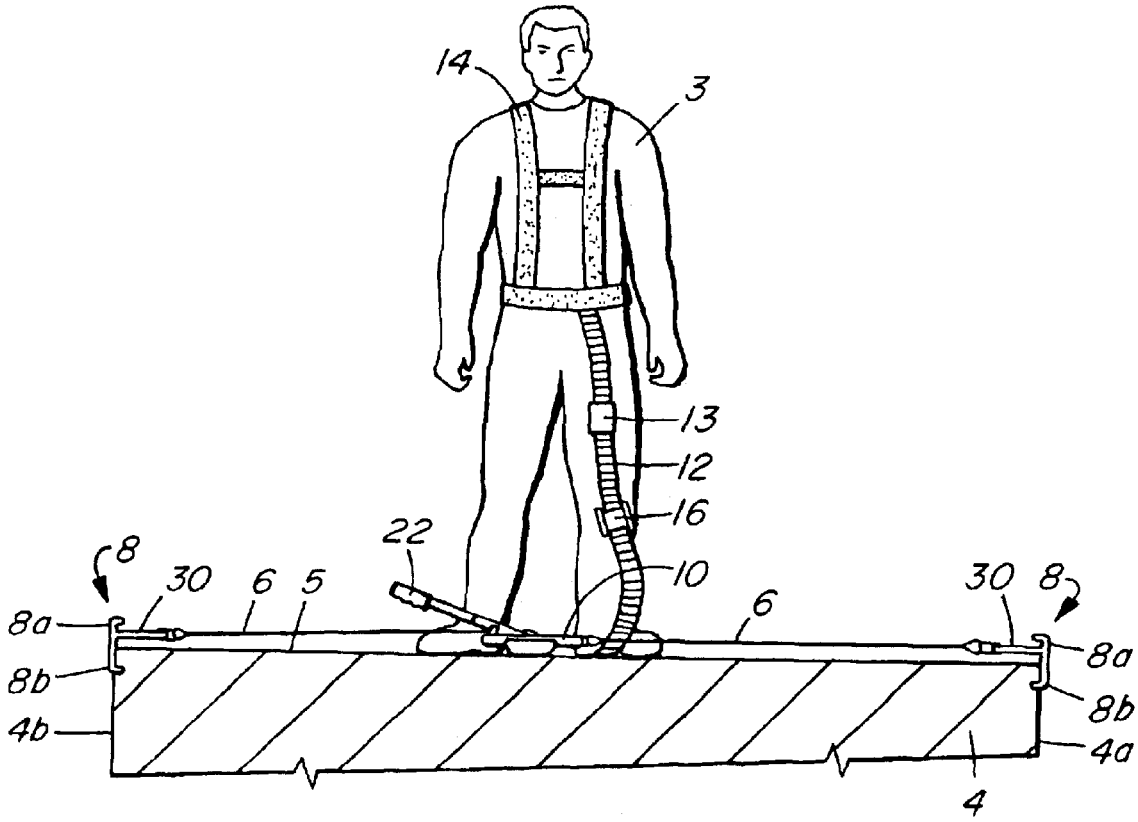
FIG. 5 is a schematic cross-sectional view showing the apparatus in place atop a container.

A restraining line or lanyard 12 is releasably connectable to flexible anchor line 6. Preferably, line 12 is connectable via a conventional clip or shackle 15 at one end to permit quick release of line 12 while ensuring reliable attachment to line 6 when in use. Referring to FIG. 5, the opposite end of restraining line 12 is connectable via a releasable clip to a harness 14 wearable by worker 3 to secure the worker to the top of the container. The illustrated restraining line 12 is a woven belt of appropriate tensile strength to support the weight of a worker but lines of other materials and configurations are possible. Lines of different length can be used depending on the dimensions of the top surface 5 of the cargo container 4. A reel 16 can also be inserted into restraining line 12 to supply additional line as needed and permit adjustment of the length of the restraining line. Reel 16 is intended to vary the length of restraining line 12 to a limited extent between 4 to 6 feet, for example, primarily to accommodate different heights of workers. Once the correct length of restraining line is set, the reel is locked by the worker. The chief function of restraining line 12 is to keep the worker away from the edge of the container. Freedom of movement over the entire top of the container is available due to the relative ease of moving and anchoring the system of the present invention at different locations along the cargo container. In the event that a worker falls from the top of the container, restraining line 12 preferably includes an energy absorbing element 13 to reduce the load experienced by a worker when their fall is stopped. For example, an energy absorbing element in the form of an elastomeric member or a stitched element that relies on ripping of the stitches to absorb the energy of a fall can be installed in restraining line 12 as best shown in FIG. 5. Such energy absorbing elements are conventional and widely available.

In a preferred arrangement, flexible anchor line 6 comprises a fixed length portion 6*a* attached to line storage device 10 and a variable length portion 6*b* receivable in the line storage device. Line storage device 10 preferably comprises a hand operated winch unit comprising a rotatable drum 20 for receiving the variable length portion 6*b* by winding about the drum. Drum 20 is rotatably mounted between a pair of side plates 21. Fixed length portion 6*a* of anchor line 6 is connected to anchor point 23 mounted to the side plates. Anchor point 23 comprises a conventional shackle or eye arrangement to securely interconnect fixed length portion 6*a* and line storage device 10. A pawl and ratchet mechanism associated with drum 20 limits rotation of the drum in one direction. Handle 22 extending from between side plates 21 is used to rotate the drum in one direction to store line and shorten the variable length portion 6*b* of the line in order to tension the line across the top 5 of cargo container 4 between edge surface 4*a* and 4*b*.

Different cargo containers are formed with different edge surfaces 4*a* and 4*b*. To ensure that the apparatus of the present invention is useful with a variety of containers, hooks 8 are preferably formed with multiple hook arms to accommodate different edge surface configurations. Alternatively, different pairs of hooks 8, each pair comprising a set of angled bracket dimensioned and shaped to engage a particular edge surface can be provided to be releasably attachable to the ends of anchor line 6. This arrangement requires that the worker select and install the appropriate hooks prior to using the system on a particular cargo container.

A more preferred approach is to provide a two-way or three way hook with hook arms adapted to engage different edge surfaces. The hook can simply be oriented to engage the correct hook arms to the edge surface encountered.

Figure 4:
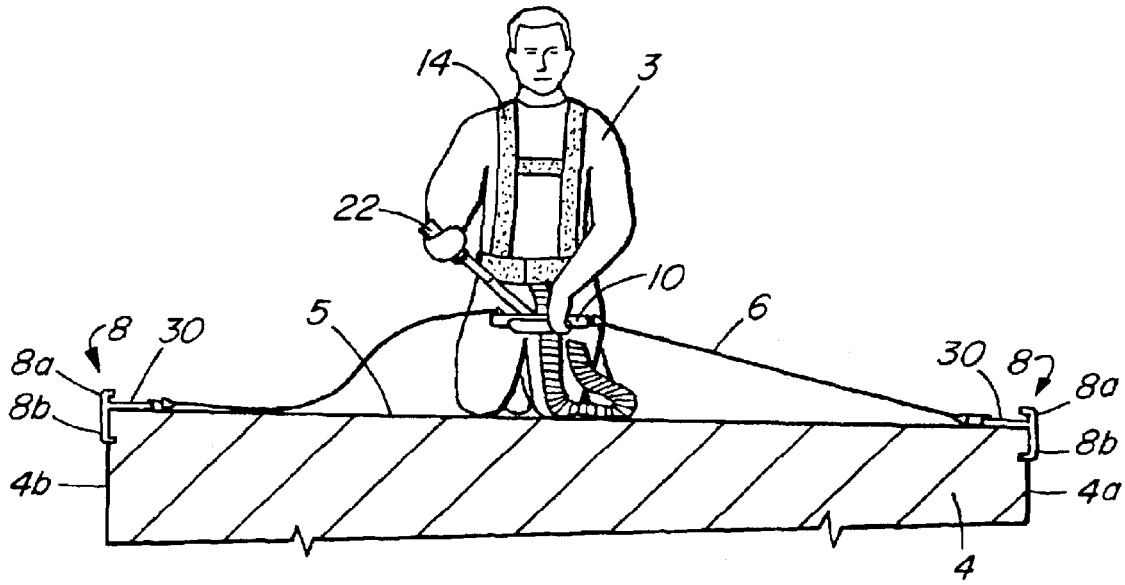
FIG. 4 is a schematic cross-sectional view showing the apparatus of the present invention being engaged atop a container using another alternative hook arrangement.

FIGS. 4 and 5 show an embodiment of the present invention in which each hook 8 is formed with two hook arms 8*a* and 8*b*. Each hook 8 comprises a main body 30 having hook arms 8*a* and 8*b* extending from opposite sides of the main body. Main body 30 defines a mounting point to permit attachment of the hook to anchor line 6. By rotating main body 30 through 180 degrees the appropriate hook arm 8*a* or 8*b* can be brought into position. In the illustrated example, arms 8*a* and 8*b* differ in length and include a distal lip to engage edge surface configurations having shoulders at different distances below the upper surface. Other combinations of hook arms are possible at opposite ends of main body 30.

Figure 2:
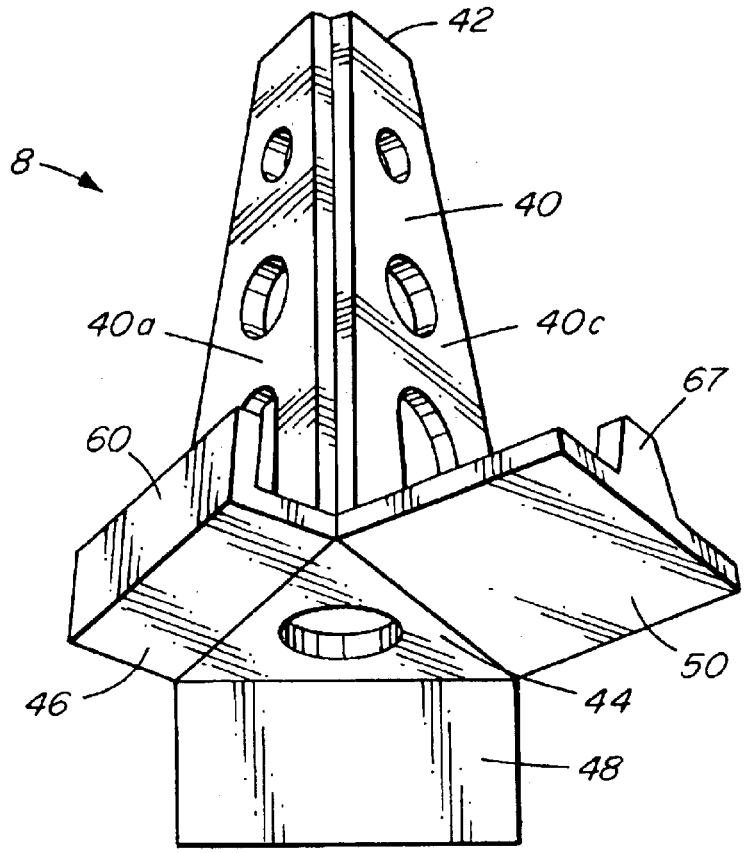
FIG. 2 is a detail end view of a preferred hook useful with the apparatus of the present invention.
Figure 3:
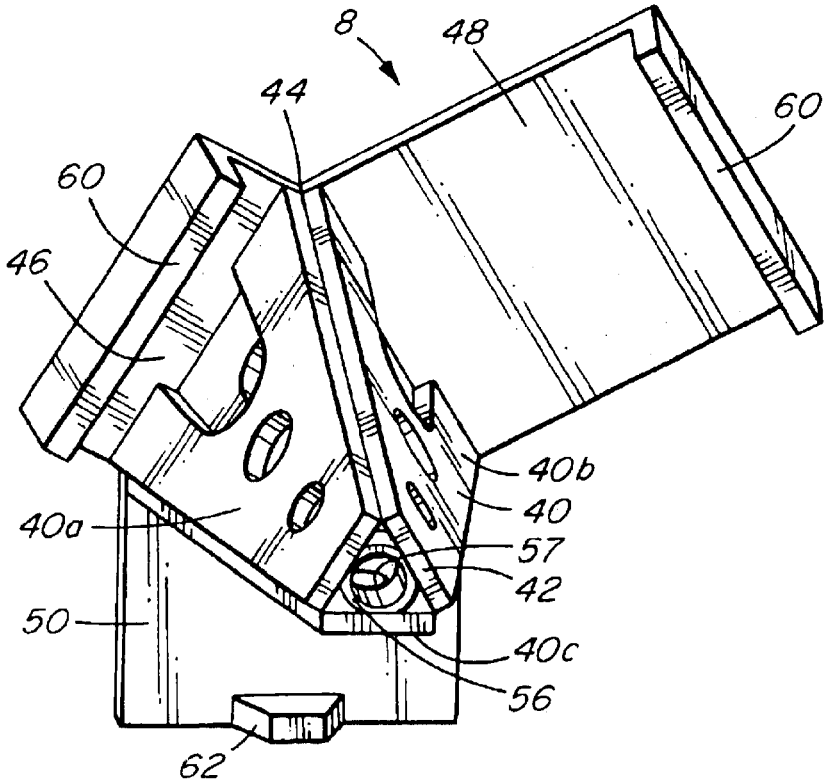
FIG. 3 is a detail view of the opposite end of the hook of FIG. 2.

FIGS. 1–3 show a preferred hook 8 designed to permit three different hook arms to be included in a single hook unit. As best shown in detail in FIGS. 2 and 3, hook 8 is formed with a generally pyramid shaped main body 40 having three sides 40*a*, 40*b* and 40*c* which extend from an apex 42 to a base 44 with a hook arm 46, 48, and 50 extending from each side adjacent base 44. In the illustrated arrangement, hook arms 46, 48 and 50 extend at substantially right angles from their respective sides 40*a*, 40*b* and 40*c* adjacent base 44 of the main body. The hook unit is preferably formed from plates of metal welded and bent into the indicated shapes. Openings 52 are preferably formed through sides 40*a*, 40*b* and 40*c* to reduce weight.

Figure 3A:
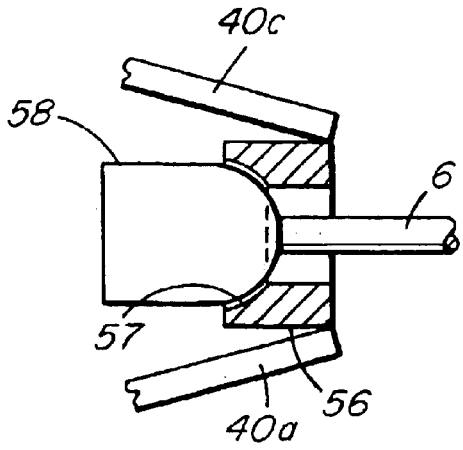
FIG. 3*a* is a detail section view of the apex end of the hook of FIG. 2 showing a ferrule connection engaging in the apex for connecting the hook to the flexible line.

Each hook is preferably attached to anchor line 6 via apex 42 in such a manner that the hook is free to rotate with respect to the line. Apex 42 of the main body is preferably formed with a generally circular opening defined by a ring member 56 inserted into the opening of the apex. As best shown in FIG. 3*a*, which is a sectional view through the apex of a hook, each anchor line 6 is formed with an enlarged end or ferrule 58 that engages against an inner shoulder 57 defined by ring member 56 to retain the main body of the hook onto the line when under tension while still permitting rotation of the pyramidal main body 40 with respect to line 6. Preferably, the inner shoulder of ring member 56 is formed with a concave surface 57*a* adapted to engage with a corresponding rounded surface 58*a* on ferrule 58 to accommodate rotary and pivoting movement between the hook and line 6 such that the hook is self-aligning with respect to the cable. Ferrule 58 can also be in the form of a sphere. Other connection arrangements between hook main body 40 and line 6 are possible including a fixed connection, however, this can lead to twisting of line 6 on rotation of hook 8 to the desired orientation. The preferred arrangement is one in which the line 6 is connected internally to hook 8 to permit free rotation of the hook with respect to the line.

In the specific hook unit illustrated in FIGS. 2 and 3, arms 46 and 48 include an angled terminal lip 60 to engage under a shoulder of the cargo container edge surfaces. Many cargo containers are formed with an edge rail that defines the edge surfaces. Terminal lip 60 is provided to fit under the edge rail to prevent the hook from dislodging vertically from the edge as an additional safety feature. Arms 46 and 48 differ only in the length of each arm to engage the underside of edge rails having different dimensions. Arm 50 is adapted to engage a different cargo container edge configuration which includes spaced indentations along the edge surface of the container. Arm 50 includes an inwardly extending projection or tooth 62 dimensioned and shaped to be insertable into an indentation to provide additional anchoring.

Figure 3B:
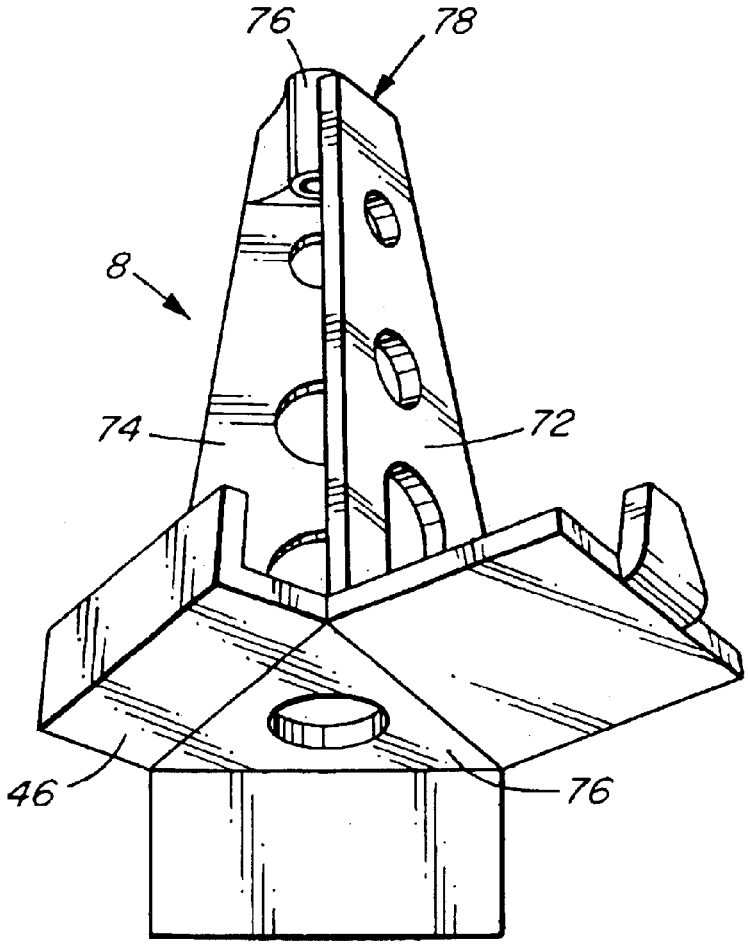
FIG. 3*b* is a detail view of an alternative hook arrangement.

FIG. 3*b* illustrates a still further design for a hook member 8 useful with the apparatus of the present invention that is a variation of the three-way pyramid hook of FIGS. 2–3. In this alternative arrangement, the generally pyramid shape body of the hook is defined by only two surfaces 72 and 74 formed by creating a bend in a single plate. The third face of the body is open. Base 76 is welded into the angle between surfaces 72 and 74. Ring member 76 for retaining a ferrule attached to flexible line 6 (not shown) is also welded to surfaces 72 and 74 at apex end 78. This alternative hook arrangement uses less material and is therefore lighter and less costly to construct. It is also lends itself to being constructed by means of automated presswork which further reduces manufacturing costs. The open third face of the body tends to allow the hook member to lie flat and seat better in snow when deployed on a container surface with the open face oriented downwardly. As illustrated, the shorter hook arm 46 is preferably adjacent the open face as the short arm tends to be the more difficult to employ in snowy conditions.

It will be appreciated by a person skilled in the art that additional hook arrangements are possible with multiple arms to accommodate any number of container edge surface configurations. Currently, a hook with 3 hook arms is adequate for use with approximately 95% of containers in the industry.

In use, the apparatus of the present invention, including anchor line 6 with attached hooks 8, anchor line storage device 10, restraining line 12 and harness 14, is carried to the top of a selected cargo container by worker 3 via a ladder or a service truck. Preferably, the worker dresses in harness 14 prior to climbing atop the cargo container. The rest of the equipment is preferably carried in a convenient container such as a small toolbox or backpack to keep the worker's hands free for climbing in a conventional manner. The worker can also drape the equipment over his shoulder prior to climbing. It is also possible for the worker to place the small toolbox or backpack containing the system on top of a service truck and deploy the equipment from the service truck roof. The equipment of the present invention is light-weight and robust and lends itself to storage in a small space.

When used in the manner described above, testing has shown that the system of the present invention takes only 20 minutes per 8 hour work shift to deploy and move. As best shown in FIG. 4, the user selects the appropriate hook arms for the cargo container edge surfaces 4*a*, 4*b*, orients the hooks 8 to use the desired hook arms and attaches the hooks to opposite edge surfaces. Hooks 8 are attached with slack in anchor line 6 to accommodate ease of handling of the hooks. Once hooks 8 are positioned adjacent edge surface 4*a*,4*b* of the cargo container, line storage device 10 is operated by the worker to shorten the line in order to retain hooks 8 at the edges of the container and pre-tension the system. As best shown in FIG. 5, worker 3 then attaches one end of restraining line 12 to anchor line 6 via a suitable connector, such as a D ring, and attaches the other end to harness 14.

For reasons of safety, it is preferable that a worker deploy the system of the present invention from the centre line of the container top surface away from the edges by tossing out the hooks to the edges with the desired hook arm oriented downwardly (in cases where hooks include multiple hook arms). Once the worker begins shortening and tensioning of flexible lines 6A,6B, hooks 8 are engaged with the edge surfaces of the container. This procedure makes it unnecessary for the worker to venture close to the edges of the container without the system of the present invention being deployed. This is particularly important during snow removal operations when the worker accesses the top of the container with a ladder at the end of the container on the centre line or from a service vehicle work platform centred over the container top surface. By standing on the ladder or work platform, the worker can deploy the device by tossing the hooks into place and tensioning the flexible lines. The worker is then protected when making the final, potentially risky climb from the ladder or work platform to the slippery top of the container. The worker then proceeds along the container top clearing snow/ice or making repairs tethered by the system of the invention. Restraining line 12 allows the worker to access only a portion of the container top surface, and when it is required to move the system to a new location, the worker returns to the centre of the container, releases the hooks by lengthening flexible line 6B, and then repeats the deployment process further along the container.

Figure 6:
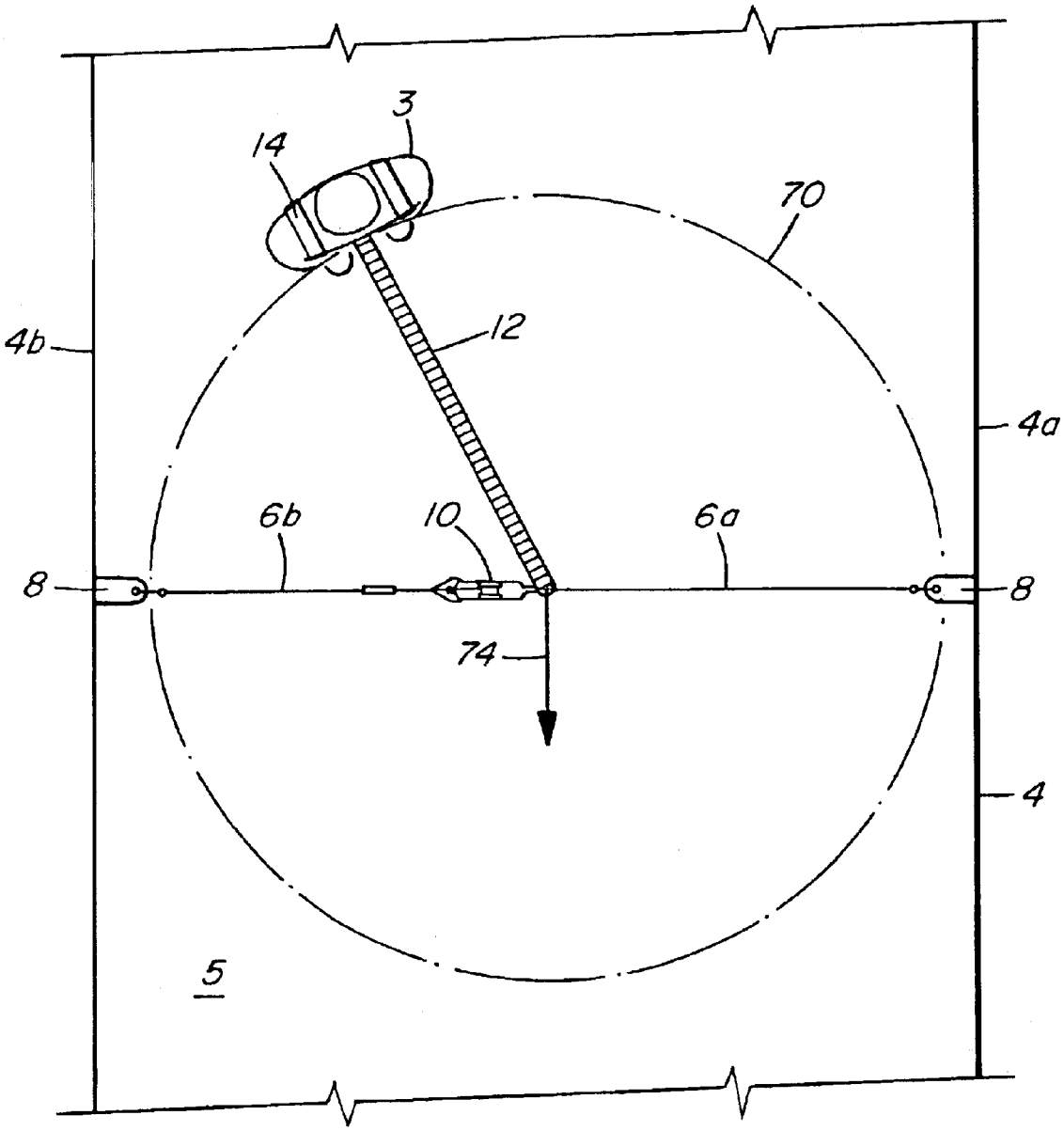
FIG. 6 is a plan view showing the apparatus mounted to a container

FIG. 6 is a plan view showing the system of the present invention in place. Preferably, restraining line 12 is attached to anchor line 6 at approximately the centre of the anchor line and the length of restraining line 12 is selected to be generally half the width of top surface 5 of the cargo container to allow worker 3 free movement within a circle 70 shown by dashed lines centred between the edge surface 4*a*, 4*b*.

Performance testing of the system of the present invention involved applying a force at right angles to the anchor line both vertically to check the hooks are anchored against upward movement, and horizontally along the length of the container (as indicated by arrow 74 in FIG. 6) to check the hooks against slippage along the edges of the container. It was determined that the apparatus could readily withstand a 1800 pound load in either direction which meets Occupational Safety and Health Association (OSHA) requirements in the United States and Canadian Labour Code and Worker's Compensation Board regulations in each Canadian province.

An important advantage of the system of the present invention is that the flexible anchor line 6 in combination with hooks 8 allow for the system to be installed across the top of the cargo container at other than right angles to the edge surface. No particular care needs to be taken to ensure that flexible anchor line 6 extends at right angles to the edge surfaces of the container. Preferably, the connection between the hooks 8 and anchor lines 6A,6B is such that the lines are free to pivot and extend across the container top. The component of the tension force in the anchor lines at right angles to the container edges ensures that hooks 8 are securely anchored to the side edges. The connection between the hooks and the lines reduces bending forces in the hooks and allows the hooks to be made from lighter material to reduce the overall weight of the system. In some cases, due to damage to the container, it is not possible to mount the system to have anchor line 6 extend at 90 degrees to the edge surface 4*a*,4*b*. With the current system, it is simply a matter of selecting a sound location for each hook at either side of the cargo container, and shortening the anchor line 6 to secure the system in place without fear of slippage of the hook members.

An important feature of the present invention is that when lines 6A,6B are properly tensioned, they will deflect to a particular angle with respect to the container edges when subjected to fall arrest loads. The pre-tensioning of lines 6A,6B limits this angle and, therefore, the majority of the load is limited to being normal to the edge of the container. Under these conditions, with the hook width sized properly, local damage to the edge of the container is minimized, particularly with container constructed using aluminum thin-skin roofs.

The preferred pawl and ratchet system to pre-tension the flexible line of the present invention allows the tensioning to be easily repeatable and ensures that a consistent compression force or normal load is applied to the edges of the container by the hooks to avoid slippage of the hooks and damage to the edges of the container.

Although the present invention has been described in some detail by way of example for purposes of clarity and understanding, it will be apparent that certain changes and modifications may be practised within the scope of the appended claims.

We claim:

1. A system for securing a worker to an elevated structure comprising:

a flexible anchor line extendable across the structure;

hooks at opposite ends of the flexible anchor line for engaging with an edge surface of the structure, each hook being formed with at least two rigid hook arms with each book arm being formed to engage with one of a plurality of edge surface configurations to anchor the hook to the edge surface by one of said at least two rigid hook arms;

a line storage device for releasably storing a portion of the flexible anchor line to adjust the length of line and tension the line to bring the hooks into anchoring engagement with the structure and secure the anchor line to the structure;

a restraining line releasably connectable to the flexible anchor line; and a harness wearable by the worker connected to the restraining line.

2. A system as claimed in claim 1 in which the flexible anchor line comprises a fixed length portion attached to the line storage device and a variable length portion receivable in the line storage device.

3. A system as claimed in claim 2 in which the line storage device comprises:

a rotatable drum for receiving the variable length portion by winding about the drum;

a pawl and ratchet mechanism associated with the drum for controlling rotation of the drum; and a manually operable handle to rotate the drum in a direction to shorten the variable length portion of the line.

4. A system as claimed in claim 1 in which each hook comprises a main body having two hook arms with each arm extending from opposite sides of the main body.

5. A system as claimed in claim 1 in which each hook comprises a pyramid shaped main body having three sides extending from an apex to a base with a hook arm extending from each side.

6. A system as claimed in claim 5 in which the pyramid shaped main body is defined by two sides and an open third side.

7. A system as claimed in claim 5 in which the apex of the main body is connected to the flexible line.

8. A system as claimed in claim 7 in which the apex of the main body is connected to the flexible line by a joint that permits relative pivotal movement between the hook and the flexible line.

9. A system as claimed in claim 8 which the joint comprises:

an enlarged end formed at the end of the flex shoulder formed at the apex of the hook defining a surface to prevent movement of the enlarged end past the shoulder while permitting relative pivoting movement between the shoulder and the enlarged end.

10. A system as claimed in claim 9 in which the apex of the main body includes an opening and the shoulder is defined by a ring member mounted in the opening.

11. A system as claimed in claim 1 in which the flexible line comprises a wire cable.

12. A system as claimed in claim 1 in which the restraining line is adjustable in length.

13. A system as claimed in claim 12 in which the restraining line includes a reel to adjust the length of the line.

14. A system as claimed in claim 1 in which the restraining line includes an energy absorbing element.

15. A system as claimed in claim 1 in which each hook is connected to the flexible line to permit relative pivoting movement between the line and the hook.

16. A system as claimed claim 15 in which the flexible line is formed with an enlarged end and each hook includes a shoulder to limit movement of the enlarged end past the shoulder while permitting pivotal movement of the enlarged end with respect to the shoulder.

17. A system as claimed in claim 16 in which the shoulder is defined by an annular member in the hook having an opening through which the flexible line passes and the enlarged end is defined by a ferrule mounted to the end of the flexible line.

18. A system for securing a worker to an elevated structure comprising:

a flexible anchor line extendable across the structure;

hooks at opposite ends of the flexible anchor line for engaging with an edge surface of the structure, each hook comprising a pyramid shaped main body having three sides extending from an apex to a base with a hook arm extending from each side, each hook arm being formed to engage with one of a plurality of edge surface configurations to anchor the hook to the edge surface by one of said at least two rigid hook arms;

a line storage device for releasably storing a portion of the flexible anchor line to adjust the length of line and tension the line to bring the hooks into anchoring engagement with the structure and secure the anchor line to the structure;

a restraining line releasably connectable to the flexible anchor line; and a harness wearable by the worker connected to the restraining line.

* * * * *